United States Patent [19]

Korpi et al.

[11] Patent Number: 4,501,647

[45] Date of Patent: Feb. 26, 1985

[54] METHOD OF ELECTROPLATING

[76] Inventors: Jouko K. Korpi, Jannelundsvägen 6 A, 693 00 Degerfors, Sweden; Teuvo T. Korpi, Kaavelantie 97 A, Helsingfors, Finland

[21] Appl. No.: 551,978

[22] PCT Filed: Jan. 21, 1983

[86] PCT No.: PCT/SE83/00016

§ 371 Date: Oct. 7, 1983

§ 102(e) Date: Oct. 7, 1983

[87] PCT Pub. No.: WO83/02786

PCT Pub. Date: Aug. 18, 1983

[30] Foreign Application Priority Data

Feb. 9, 1982 [SE] Sweden ..... 8200728

[51] Int. Cl.[3] ..... C25D 5/34

[52] U.S. Cl. ..... 204/23; 204/28; 204/32.1

[58] Field of Search ..... 204/15, 28, 23, 32.1, 204/34

[56] References Cited

U.S. PATENT DOCUMENTS

| | | | |
|---|---|---|---|
| 3,582,479 | 6/1971 | Urban | 204/28 |
| 3,650,935 | 3/1972 | Andersson | 204/206 |
| 3,720,596 | 3/1973 | Draghicescu | 204/DIG. 7 |
| 3,871,982 | 3/1975 | Idstein | 204/207 |
| 3,926,767 | 12/1975 | Brendlinger | 204/28 |
| 4,183,799 | 1/1980 | Sellitto | 204/DIG. 7 |

*Primary Examiner*—Thomas Tufariello

*Attorney, Agent, or Firm*—Dennison, Meserole, Pollack & Scheiner

[57] ABSTRACT

The invention relates to a method of electroplating metal, primarily chromium, onto a workpiece connected as a cathode in a current circuit, the workpiece being fed through an electrolyte bath past the anode of the current circuit. Prior to moving the workpiece past the anode, the workpiece is moved past a member in the electrolyte bath which is generally parallel to the direction of movement of the workpiece and which is generally closer to the workpiece than the anode. This member controls the current density between the member and the workpiece, causing the workpiece to be etched as it passes the member.

11 Claims, 5 Drawing Figures

Figure 1:
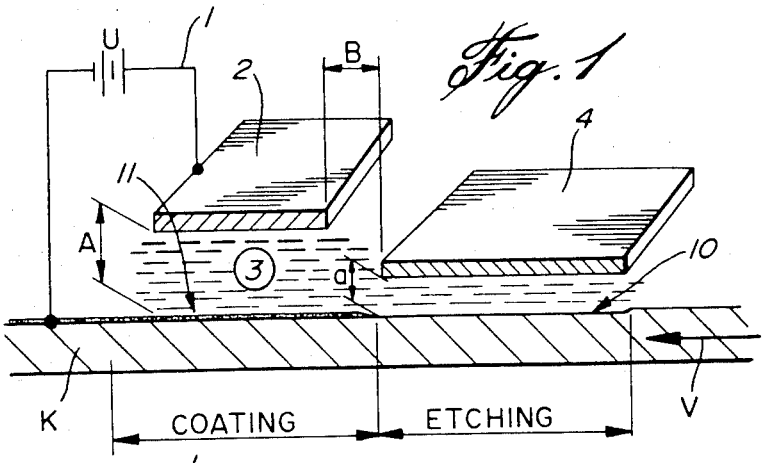

U
1
2
B
4
11
A
3
a
10
K
COATING
ETCHING
V

U
1
2
B
5
11
A
3
a
10
K
COATING
ETCHING
V

U
1
2
B
U
7
6
11
A
3
a
10
K
COATING
ETCHING
V

Fig. 4
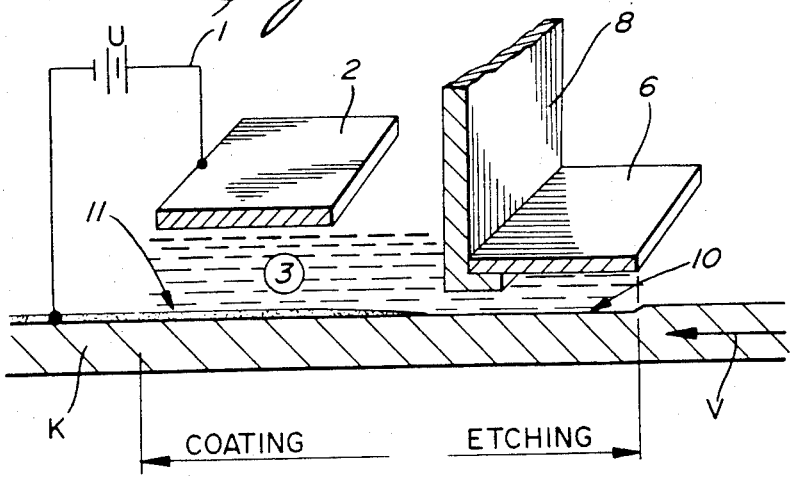
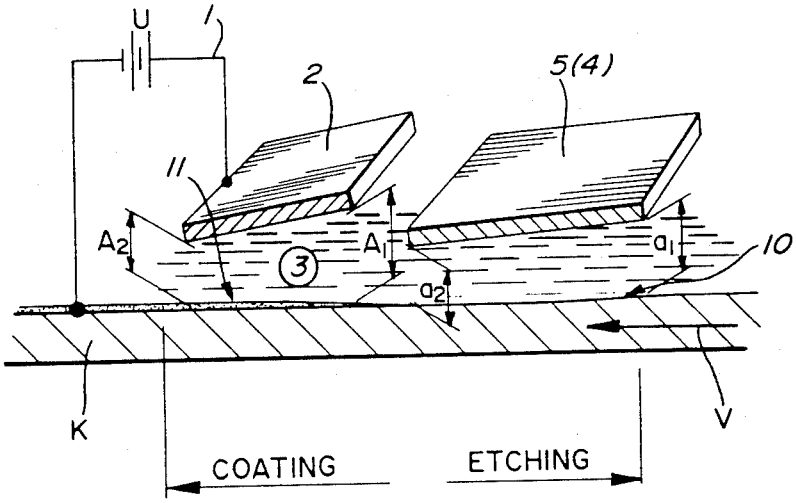
Fig. 5

METHOD OF ELECTROPLATING

The present invention relates to a method of electroplating metal, primarily chromium, onto a workpiece connected as cathode in a current circuit, said workpiece being fed through the electrolyte at a predetermined speed past the anode and any auxiliary anodes in the current circuit.

Electroplating metal on a cathode from an electrolyte entails relatively difficult and sensitive processes in which small variations in the current density between anode and cathode in the electrolyte may give rise to completely different properties in the coating and adhesion to the coated surface.

The present invention relates both to a method of achieving better adhesion to the coated surface and to a method of improving the density of the coating itself.

Over the years a considerable number of patents have been granted describing various methods of electroplating metal objects.

German patent No. 484.206, dealing with chromium plating, proposes that initially the workpiece to be chromium plated is permitted to act as anode in order to etch the original surface to give better adhesion at subsequent electroplating with the workpiece as cathode. Nowadays this method is used generally.

Furthermore, the German patent No. 923.405 maintains that a more easily polished chromium surface is obtained if electroplating is performed in periods broken by short periods when the current is cut but the workpiece is allowed to remain in the electrolyte.

Swiss patent No. 498 941 describes a method of chromium plating elongate objects by gradually moving them through an anode.

Swedish published specification No. 310 970 also reveals that when electroplating with chrome, for instance, the current density must be controlled over the entire area to be plated since differences in area, geometry or accessibility may cause the current density at some parts of the cathode to be so low that no plating at all occurs there. On the contrary, a warning is given that particularly unfavourable surfaces may be etched instead. From the second paragraph on page 3 of the published specification it is evident that cast-iron and steel cathodes are considered especially liable to such undesired etching in chromium-plating baths.

To avoid the above problems the published specification proposes placing an auxiliary electrode close to the area where the current density is either too low to give the desired plating or gives plating which is not desired on a particular part of the surface, because the current density is too high. The auxiliary electrode shall in this case be connected to a current source which is independent of the current circuit connected between anode and cathode.

The problem of etching in chromium baths with too low current density has also been discussed in U.S. Pat. No. 4,062,741 where it is suggested to connect a protective voltage of a few volts across those objects which must remain in the chromium-plating bath even after the current has been cut.

The method most frequently used in practice has otherwise been to first etch the object in question with inverse polarity and then plate it in the same bath.

The present invention relates to a new method resulting in a considerable improvement in the adhesion of the plated surface coating as well as its quality, by performing the etching and plating closer together in time and by enabling the pole-changing method to be avoided.

The method according to the invention is based on experience of electroplating gathered over the years, also verified in the patents discussed above. At the same time, however, the inventive concept offers a completely independent solution to previously unsolved problems. As already mentioned in the introduction, the method according to the invention relates to electroplating a metal, primarily chromium, onto a workpiece acting as cathode, said workpiece being fed through an electrolyte at a predetermined speed past an anode where depositing of the metals is effected.

The method according to the invention is based on the cathode being continuously etched immediately before it reaches the anode. Since this takes place continuously the pole-changing method, which has a number of drawbacks as already intimated, cannot be used.

According to the invention this continuous etching is achieved by arranging a member immediately before the anode, said member controlling the current density between itself and the cathode so that the surface is etched. This member may either be entirely electrically insulating or connected in a current circuit with the cathode in such a way that the current density provides etching of the cathode when it passes the member in question. The method according to the invention can also be performed by arranging several pairs of etching members and anodes successively in the same electrolyte. The quality of the plated coating can also be improved by varying the distance between cathode and etching member and between cathode and anode along a distance along which the cathode is moved past these. In this way the current density, and thus the degree of etching, and the density of the electroplating can be varied to the desired value at each point along the surface of the cathode. The opportunity of giving the plated surface different hardness at different depths in this way may be of particular value. Certain other advantages can also be achieved and the entire etching-plating process can be carried out under partial vacuum. The method according to the invention is defined in the following claims and will now be further described in connection with a number of basic sketches of arrangements for performing the method.

In this connection it may be mentioned that the method according to the invention has been tested with good results at the State Institute of Technical Research in Helsingfors, test report MRG 1776.

FIGS. 1–5 are basic sketches and such conventional elements as electroplating baths, measuring means and complete electrical connecting systems have been omitted or merely intimated.

FIG. 1 shows the basic principle of the method according to the invention. A workpiece K is connected as cathode in the current circuit 1 with current source U. The anode is designated 2 and the electrolyte 3. The cathode K is fed continuously in the direction of the arrow V. Immediately before the workpiece K (cathode) reaches the anode 2, it passes under the member 4, characteristic for the invention, which constitutes an electrically insulating shield in the basic form shown in this figure. The distance between the anode 2 and the cathode K and the voltage of the current source U are essential variables with respect to the plating, while the distance a between the insulating member 4 and the cathode K and the distance B between the member 4 and the anode 2, together with the current strength over the anode, determine the etching. It is the current density which controls both etching and plating. All the variables discussed above are values which must be empirically determined. Etching takes place in the region 10 and plating in the region 11.

Figure 2:
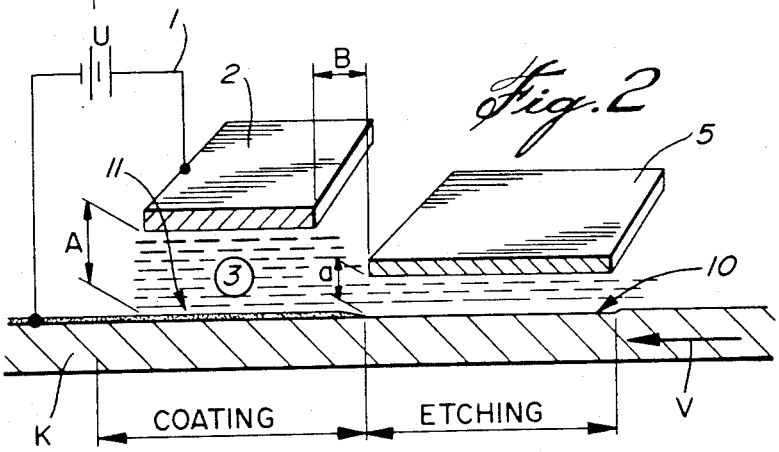

In the embodiment shown in FIG. 2 the insulating member 4 is replaced by an electrically conducting member 5 which will thus in practice function in the same current circuit as the anode 2 and cathode K. This means that the previously mentioned valiables must be adjusted depending on the conditions prevailing.

Figure 3:
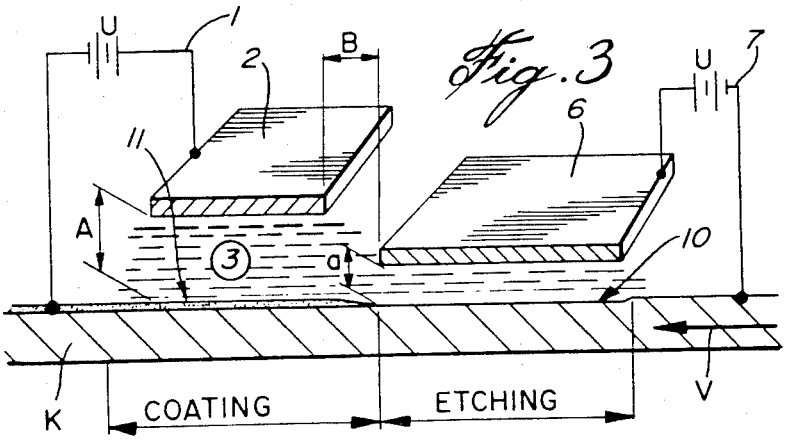

In the embodiment shown in FIG. 3 a member 6 to intensify the etching has been connected into its own current circuit 7 and has its own current source. The conditions discussed earlier apply here except that the previously mentioned variables must be given other values.

In the embodiment shown in FIG. 4 an insulating layer 8 has been arranged between the anode 2 and the member 6 intensifying the etching. It should be noted that the insulating layer 8 extends some way between the member 6 and the cathode K. This is not always necessary but may sometimes be advisable. A current circuit 7 may be connected to the member 6 as shown in FIG. 3.

FIG. 5 illustrates a modification in which the distance between anode and cathode (A1-A2) and between the etching-intensifying member 5 (4) and cathode (a1-a2) varies along the path of the cathode past said member and the anode. The member 5(1) may consist of an electrically conducting member 5 as in FIG. 2 or of an insulating member 4 as in FIG. 1. According to this embodiment it is possible to influence the etching process along the member 5(4) in order to produce plating with gradually changing properties between the bottom and surface layers, for instance.

The variants shown in the drawings can to a great extent be combined with each other to achieve desired properties in the plating layer. For instance an insulating member 4 as well as an electrically conducting member 5 may be used arranged one after the other in the direction of movement of the workpiece (cathode).

Practical experiments have proved that the quality of the coating can be highly improved by having the workpiece passing an anode, that is divided up in several parts by an insulating and shielding protection or by using several successive anodes having insulating and shielding protection between each other. The anodes may have different sources of current supply and different voltages. The quality of the coating can also be improved by giving the anode at the end an insulating and shielding protection resulting in a gradually decreasing current density.

We claim:

1. In a method for electroplating metal onto a workpiece which is connected as a cathode in a current circuit, wherein said workpiece is moved through an electrolyte bath past at least one anode which is arranged generally parallel to the direction of movement of the workpiece, the improvement comprising:

prior to moving said workpiece past at least one anode, moving the workpiece past a member in said bath arranged generally parallel to the direction of movement of the workpiece and which member is generally closer to said workpiece than said anode, whereby said member controls the current density between said member and said workpiece, causing said workpiece to be etched as it passes said member.

2. Method according to claim 1 wherein said member comprises an electrically insulating shield.

3. Method according to claim 1 wherein said member is electrically conducting and forms an element in said current circuit comprising the workpiece and the anode.

4. Method according to claim 1, wherein said member is electrically conducting and forms the anode of a second current circuit comprising said workpiece as cathode.

5. Method according to claim 3 or 4, wherein said member is separated from the anode of said current circuit by an electrically insulating member at least part of which is arranged between said member and the part of said workpiece to which it is closest.

6. Method according to claim 1, wherein the distance between said anode and said workpiece varies along the direction of movement of said workpiece, thereby causing a varying current density between said anode and said workpiece.

7. Method according to claim 6, wherein the distance between said anode and said workpiece decreases in the direction of movement of said workpiece.

8. Method according to claim 1, wherein the distance between said member and said workpiece varies in the direction of movement of said workpiece.

9. Method according to claim 1, additionally comprising repeating the steps of moving said workpiece past a member and past an anode, thereby increasing the thickness of the electroplated metal.

10. Method according to claim 1, wherein said method is performed under partial vacuum.

11. Method according to claim 1, wherein chromium is being electroplated from said electrolyte bath.

* * * * *